United States Patent [19]

Wang

[11] Patent Number: 4,906,012

[45] Date of Patent: Mar. 6, 1990

[54] SELF-PROPELLED QUADRUPEDAL TOY

[76] Inventor: Chin-Chi Wang, No. 54, Alley 15, Lane 112, Chung San Rd., Sec. 2, Su Lin Chen, Taipei Hsien, Taiwan

[21] Appl. No.: 265,975

[22] Filed: Nov. 2, 1988

[51] Int. Cl.[4] ..... A63G 19/00

[52] U.S. Cl. ..... 280/1.181; 280/1.13; 280/1.206; 280/1.208

[58] Field of Search ..... 280/1.13, 1.16, 1.165, 280/1.167, 1.181, 1.182, 1.195, 1.201, 1.202, 1.204, 1.208

[56] References Cited

U.S. PATENT DOCUMENTS 1,337,479 4/1920 Loomis ..... 280/1.181

3,815,931 6/1974 Morrison et al. ..... 280/1.208

*Primary Examiner*—Charles A. Marmor

*Assistant Examiner*—Donn McGiehan

*Attorney, Agent, or Firm*—Varndell Legal Group

[57] ABSTRACT

The present invention is related to a self-propelled quadrupedal toy and, more particularly to a quadrupedal toy (toy horse, dog or deer etc.) having a driving mechanism equipped with two protruding handlebars for the rider (children) to operate to let the quadrupedal toy rock or swing or rock and swing. One or two hand brake levers (control levers) are provided to let the rider to freely control the quadrupedal toy for walking forward or backward, or turning leftward or rightward, or for jogging or stopping, in a manner, similar to the motion of riding a real horse or animal.

6 Claims, 4 Drawing Sheets

SELF-PROPELLED QUADRUPEDAL TOY

BACKGROUND AND SUMMARY OF THE INVENTION

Conventional toy horses or animals which are prepared for children to plate or to ride may be made of wooden, or plastic or metal material. These toy animals are applicable for rocking or forward and backward displacement (walking). However, they provide limited variation at play and produce less fun in exercise. After a short period of time, children may be easily tired of playing such toy animals and may put them aside.

In view of said problems, the present invention is thus created to provide such a self-propelled quadrupedal toy equipped with two protruding handlebars for the rider (children) to operate to let the quadrupedal toy rock or swing or rock and swing. One or two hand brake levers (control levers) are provided to let the rider to freely control the quadrupedal toy to walk forward or backward, or to turn leftward or rightward, or to jog, or to stop, similar to the motion of riding a real horse or animal, so as to take real exercise and to produce much fun.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 1-1 is a longitudinal sectional view drawing of the neck portion as well as the joint of the hind legs of the present invention.

FIG. 3-1 is a schematic view drawing illustrating the forward motion of the right-sided fore leg and the left-sided hind leg of the present invention.

FIG. 4-1 is a schematic drawing illustrating the forward motion of the left-sided fore leg and the right-sided hind leg of the present invention.

DETAILED DESCRIPTION OF THE PREFERRED EMBODIMENTS

Figure 1:
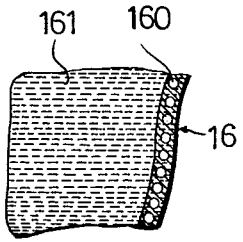
FIG. 1 is a schematic drawing illustrating an outer appearance of an embodiment according to the present invention.
Figure 1:
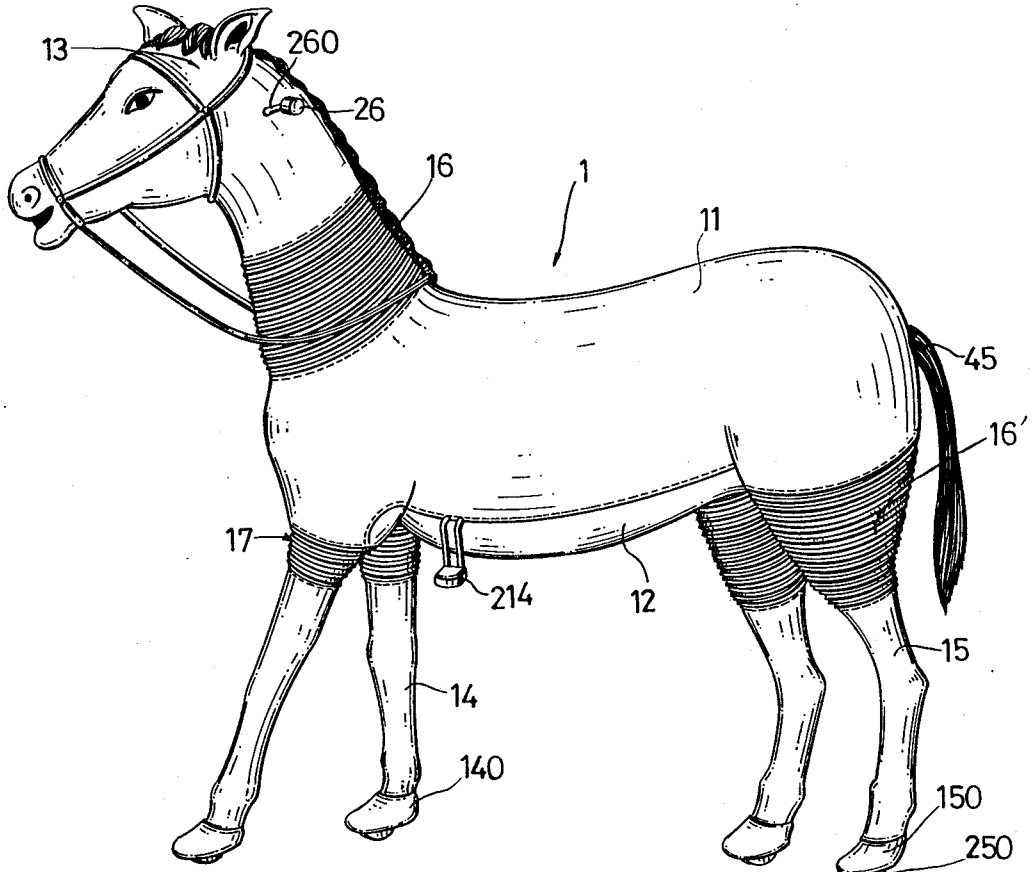
Figure 2:
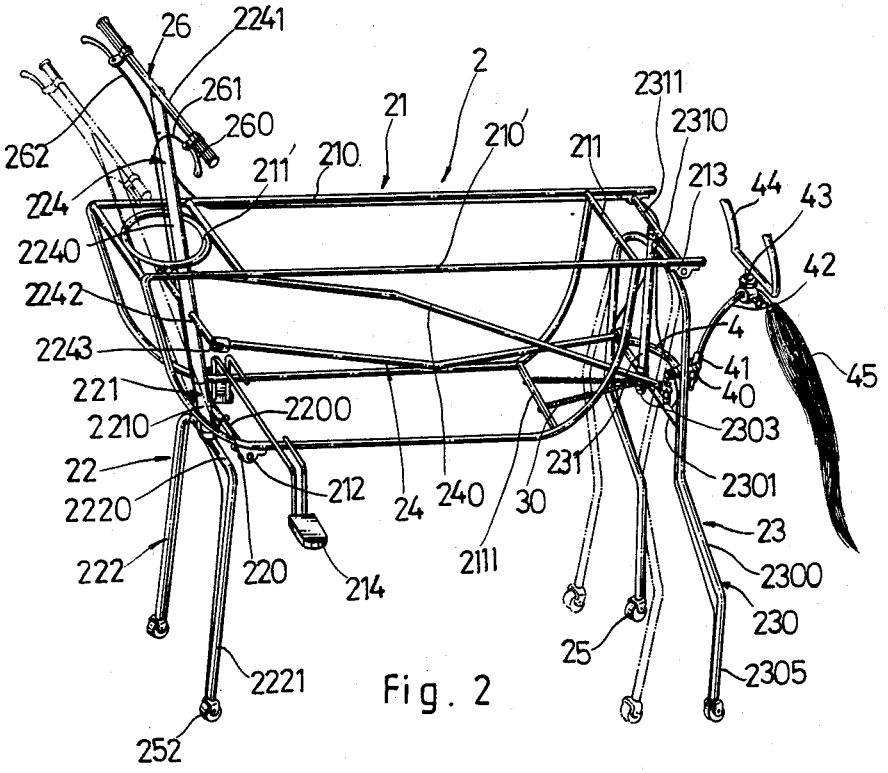
FIG. 2 is a perspective structural view drawing of the driving mechanism of the present invention.

Referring to the drawing of the outer appearance of the present invention and the perspective structural view drawing of the driving mechanism of the present invention as shown in FIGS. 1 and 2, the embodiment has a horse-shaped body 1 (as shown in FIG. 1), being arranged to provide an inner space for a driving mechanism 2 (as shown in FIG. 2) to set therein. The said horse-shaped body 1 which may be arranged to provide an outer appearance similar to dog, deer or other animals is built-up with upper body 11, bottom abdomen 12, head portion 13, fore legs 14 and hind legs 15. The whole body 1 is made of plastic or fiber glass material through shape-molding process according to the shape and size of preferred animal. The neck portion 16, each hind leg joint 16', and each hind leg joint 17 are respectively arranged to provide a flexible or pliable section made of soft rubber or corrugated sack, so as to allow the head portion 13, fore legs 14 and hind legs 15 to made upward and downward oscillating movement, and forward and backward displacement. The corrugated sack of the fore leg joint 17 has a structure similar to the corrugated sack of regular pneumatic thermos bottle. The soft rubber section of the neck portion 16 and the fore leg joint 16' is a pliable cylinder of which the cylindrical wall 160 is made of rubber or soft plastic with spring wires 161 set therein in proper sequence and interval similar to the structure of steel wire engaged high pressure pipe.

Referring to the driving mechanism 2 as shown in FIG. 2, it is comprised of a main frame 21, a fore leg driving bracket 22, a hind leg driving bracket 23, two link levers 24, four sets of driving devices 25, and two control handlebars 26. The said main frame 21 is comprised of one pair of D-shaped or flat O-shaped frames 210, 210' arranged apart parallel with each other by means of the connection of a plurality of cross bars 211 through welding joint or screw joint. One set each of two bearing blocks 212, 213 are arranged at the front lower position and the rear upper position of the main frame 21 respectively for pivotal connection with fore leg driving bracket 22 and hind legs driving bracket 23. One pair of pedals 214 are attached to the main frame 21 at the front at both sides for child to pedal while riding on the body 1. A ring plate 211' is fixedly attached to the frames 210, 210' of the main frame 21 between two cross bars 211 and arranged at horizontal level to limit and guide the movement of fore leg driving bracket 22 so as to provide life-like motion.

Figure 5:
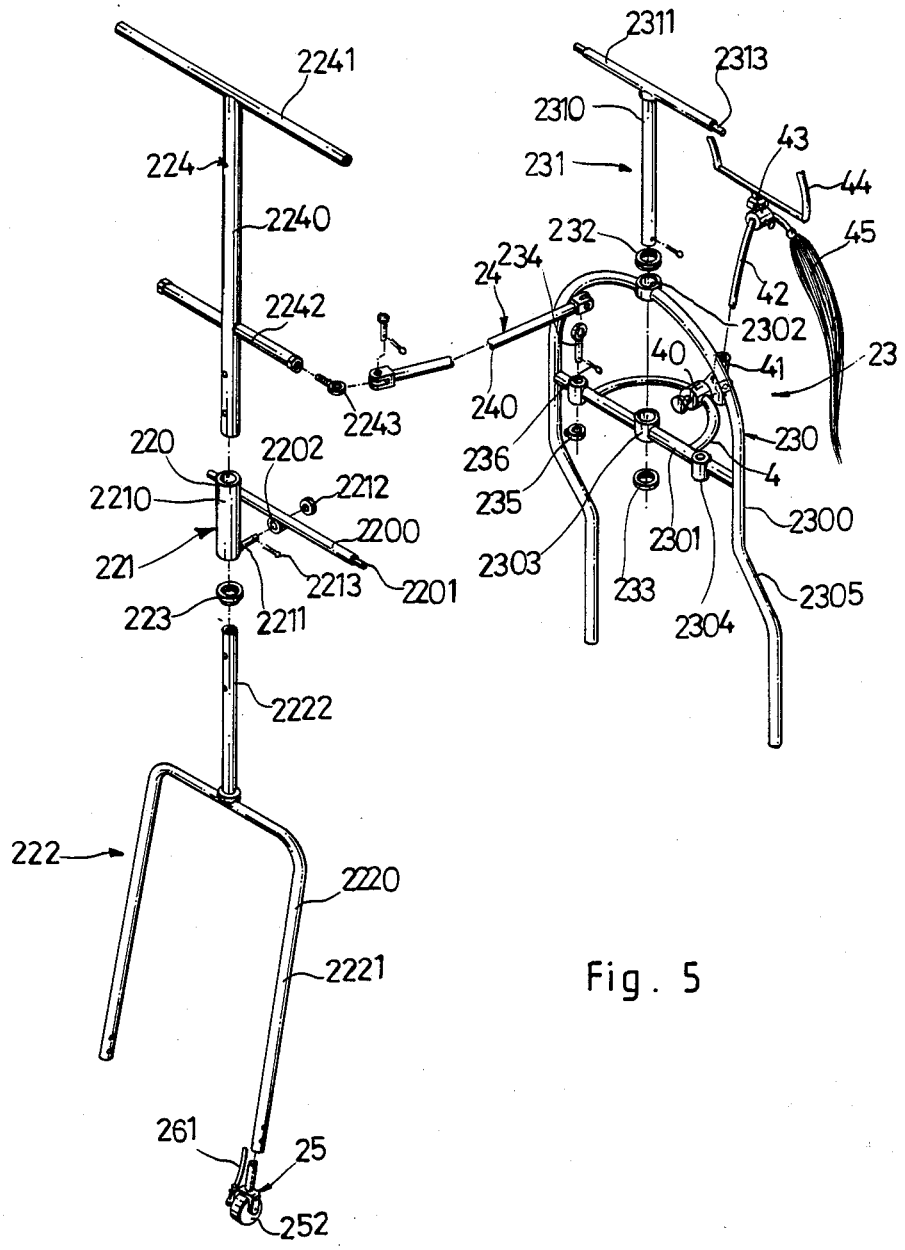
FIG. 5 is a partially fragmentary assembly view drawing of the driving mechanism of the present invention.

The said fore leg driving bracket 22, as illustrated in FIG. 5, is comprised of a locating bar 220, a locating tube 221, a fore leg actuating frame 222, a bearing 223, and an operating lever 224. The said locating bar 220 is comprised of a central portion 2220, a protruding rod 2201 made at the both ends of the central portion 2200 in a relatively smaller diameter, a sleeve 2202 arranged at the center in vertical to the central portion 2200, which is pivotally connected to the main frame 21 between the two bearing blocks 212 such that the fore leg driving bracket 22 is connected with the main frame 21 by means of the locating tube 221. The said locating tube 221 has a cylindrical portion 2210 comprising a transverse rod 2211 protruding outward to insert into the sleeve 2202 of the central portion 2200 of the locating bar 220 for further fixation through a washer 2212 and a cotter pin 2213, so as to let the locating tube 221 and the locating bar 220 be fixedly connected together. The said fore leg actuating frame 222 has a Y-shaped frame body 2220 comprising one pair of symmetrical arm rods 2221 to match with the shape and size of the fore legs 14 of the body 1, wherein each arm rod 2221 is arranged to provide a driving wheel gear 25 at the bottom. The upper axial rod 2222 of the fore leg actuating frame 222 which is longer than the locating tube 221 and arranged to match with the cylindrical portion 2210 of the locating tube 221 is connected with a bearing 223 and inserted into the cylindrical portion 2210 to fixedly connect with the operating lever 224 through screw joint. The operating lever 224 is a F-shaped frame body 2240 of which the upper cross bar 2241 is connected with one pair of control levers 260 arranged at both ends with respective control cords 261, 262 provided to form a clutch control handle 26 similar to that of motorcycles. The lower cross bar 2242 of the operating lever 224 is respectively connected with one bearing 2243 at both ends by means of pivotal (screw) joint for further connection with the hind leg driving bracket 23 through one pair of link levers 24.

The said hind leg driving bracket 23, as illustrated in FIG. 5, comprises a hind leg actuating frame 230 and an actuating lever 231 pivotally connected with the hind leg actuating frame 230. The said hind leg actuating frame 230 which is a semi-circular A-shaped tube 2300 with a cross bar 2301 arranged therebetween comprises a vertical sleeve 2302 at the upper center and another vertical sleeve 2303 at the center of the cross bar 2301 for pivotal connection of the said actuating lever 231. The said cross bar 2301 comprises two sleeves 2304 made at both sides for fixation of respective bearings 234 by means of respective washers 235 and cotter pins 236 so as to further connect with the said pair of linking levers 24. The shaped and size of the two arms 2305 of the frame 2300 are arranged to match with the shape and size of the hind legs 15 of the body 1. Each arm 2305 is also arranged to provide a driving wheel gear 25 at the bottom. One pair of springs 30 is arranged in a V-shape to connect the sleeve 2303 of the cross bar 2301 and the cross bar 2111 of the main frame 21, so as to match with the arms 2305 to swing. A semicircular frame 4 which is made at the outer side of the cross bar 2301 comprises a steering device 40 movably connected with a loop bar 41 through pivotal joint. The said loop bar 41 is further connected with an extension rod 42 by slip joint. The said extension rod 42 is arranged to provide a knuckle 43 for connection with an U-shaped frame 44 at the top. An artificial animal tail 45 is also pivotally connected to the knuckle 43 to follow the hind leg driving bracket 23 to synchronously swing. The said actuating lever 231 is a T-shaped lever 2310 of which the upper transverse rod 2311 is arranged to provide a protruding rod 2313 at both ends in relatively smaller diameter for fixation with the main frame 210 between the two bearings 213. The vertical rod 2310 of the T-shaped lever 2310 is mounted on the actuating frame 230 and inserted through the bearings 232, 233 and the sleeves 2302, 2303 of the A-shaped tube 2300 and further fixed by a cotter pin 2313, thereby permitting the hind leg actuating frame 230 to be coupled with the actuating lever 231 to form a hind leg driving bracket 23.

The said two link levers 24 which have a "-" shaped or V-shaped configuration 240 are arranged to cross each other to respectively connect with the operating levers of the fore leg driving bracket and the hind leg driving bracket and the fore leg actuating frame at both ends by pivotally screw joint, so as to let the fore leg and hind leg actuating frames to synchronously make rightward-leftward and forward-backward movement.

Figure 7:
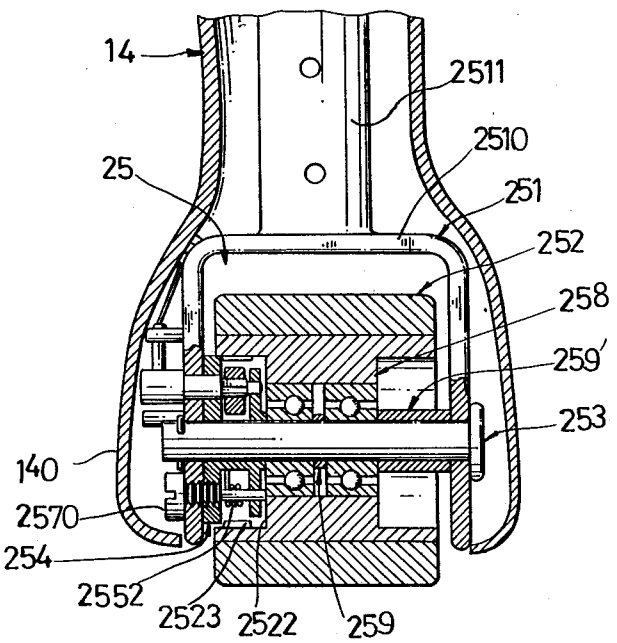
FIG. 7 is a front longitudinal sectional view drawing of the driving wheel gear of the driving mechanism of the present invention.
Figure 6:
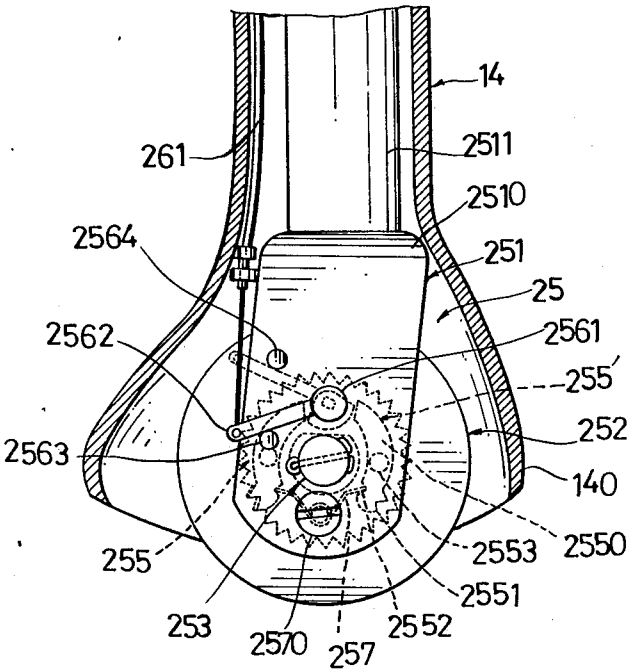
FIG. 6 is a side view drawing of the driving wheel gear of the driving mechanism of the present invention.

Each of the said driving wheel gear 25, as illustrated in FIGS. 6 and 7, is mainly comprised of wheel holder 251, driving wheel 252, wheel axle 253, ratchet holder 254, left brake shoe 255, right brake shoe 255', brake cam 256, and brake spring 257.

The said wheel holder 251, as illustrated in FIG. 7, is an U-shaped frame plate 2510 connected with a protruding sleeve 2511 at the top, wherein the upper protruding sleeve 2511 is for fixation with the actuating frame 222 or 230 of the driving bracket 22 or 23, and the U-shaped frame plate 2510 is for fixation of driving wheel 252 and the other componet parts of the driving wheel gear 25. The said driving wheel 252, as illustrated in FIG. 7, is comprised of a wheel hub 2520 and a rubber tire 2521 wherein the inner wall of the wheel hub 2520 comprises a slot 2522 with an internal gear 2523 arranged thereinside for connection with a ratchet holder 254 and the other component parts of the braking mechanism; and the wheel axle 253 is arranged to provide one or two bearings 258, washer 259 and sleeve 259'. The whole driving wheel assembly 252 is further pivotally mounted on the U-shaped frame plate 2510 of the wheel holder 251. The said ratchet holder 254 which is a H-shaped plate comprising two lateral disc plates 2541, 2542, as illustrated in FIG. 7, is mounted on the axle of the driving wheel 252. The outer side of the two lateral disc plates 2541, 2542 are respectively connected with a brake shoe 255, 255'. A cam shaft 2561 is mounted on the upper side between the brake shoes 255, 255' for fixation with a cam wheel 256 by pivotal joint, and a brake spring 257 is pivotally mounted on the lower side between the brake shoes 255, 255' by means of a bolt 2570, such that the driving wheel 2521 is controlled to make forward and backward one-way rotation (in normal condition, it is as shown in FIG. 6, and can only make a forward motion of counter clockwise rotation but not applicable for backward motion of clockwise rotation). Each of the said two brake shoes 255, 255' is a curved plate 2550 comprising slot 2552 and several protruding teeth 2551. Both brake shoes 255, 255' are respectively mounted on a position between the two disc plates 2541, 2542 of the ratchet holder 254 by means of a pin 2553, and correspondingly arranged like the brake shoes of regular motorcyles. The said cam wheel 256 is a sector-like cam arranged to provide proper size and angle, mounted on the upper position between the said two brake shoes 255, 255' by means of cam shaft 2561. The said cam shaft 2561 is set in the ratchet holder 254 through the wheel holder 251 for pivotal fixation with the cam wheel 256 at the outer side. Therefore, the cam shaft 2561 is concomitantly acting as a locating rod for the ratchet holder 254. A rocker 2562 is mounted on the outer side of the cam shaft 2561 to couple with control cord 261 or 262 such that the control lever 260 of either handlebar is pressed down the control cord 261 or 262 is driven to pull the rocker 2562 to swing from the lower locating pin 2563 toward the upper locating pin 2564 (as indicated in the dotted line in FIG. 6), to further drive the cam wheel 256 to move clockwise, and to push the left brake shoe 255 to move outward (leftward) so as to let the several teeth 2551 be separated from the engagement with the internal gear 2523. At the same time, the left brake shoe 255 is free from the cam wheel 256 and forced by the brake spring 2552 to move outward (rightward) to let the several teeth 2551 be engaged with the internal gear 2523 to drive the driving wheel to clockwise rotate and to move backward. The said brake spring 2552 which is used to push the two brake shoes outward is comprised of a spring coil with two extension rods arranged at both ends to respectively set in the slot 2552 of each brake shoe 255, 255' at the time the brake spring 2552 is fixedly attached to the ratchet holder 254 by a bolt 2570. The said bolt 2570 which is to screw from the outer side of the wheel holder 251 into the ratchet holder 254 acts concomitantly as a locating bolt for the ratchet holder 254 to let the ratchet holder 254 be screwed up with the wheel holder 251.

The said driving wheel gear 25 is mounted on the hoof or cylindrical portion 140 or 150 of every fore or hind leg 14 or 15 of the horse or animal body 10, letting the driving wheel 252 be protruding therebeyond for a proper distance (as shown in FIGS. 1, 6 and 7) such that the child who rides the horse or animal on the body 10 can drive the toy animal to displace forward, backward, leftward, and rightward, through the landing and rotation of the wheels 252 of the four driving wheel gears 25 respectively mounted on the four legs 14, 15.

According to the present invention, a left and a right handlebars 26 are provided with a respective control lever 260 attached thereto to control the four driving wheel gears 25. Therefore, two of the control cords 26, 26' of the fore and hind legs 14, 15 are fastened into one line to further connect to the control lever 260 of either handlebar 26 so as to let each control lever 260 of either handlebar 26 simultaneously control the fore legs or hind legs 14, 15 to make backward displacement.

According to the present invention, some component parts of the four driving wheel gears 25 are mounted on the outer surface of the body 10 (as shown in FIGS. 1, 6 and 7). The two handlebars 26 and two pedals 214 of the driving mechanism 20 are respectively mounted on the head portion 13 and the front portion of the bottom abdomen 12 of the body 10 arranged at both sides to let child who rides the present toy animal hold and control the handlebars 26 and pedal the two pedals 214. The other component parts of the driving mechanism 20 are arranged inside the body 10 to not interfere with said motion and play.

The control operation of the present self-propelled horse (or animal) is proceeded as hereunder:

1. Forward movement of the two hind legs 15: Hold the two handlebars 26 and push them ahead without pressing down the control levers 260 (as illustrated in the dotted line in FIG. 2). Because the driving wheel gears 25 are at normal condition, the wheels 252 are driven to move forward and will not move backward. Therefore, through the operating lever 224 of the fore leg driving bracket 22 the two link levers 24 are pushed to drive the hind leg driving bracket 23 and the accompanied two hind legs 15 to displace forward while the two fore legs 14 remain immovable.

2. Forward movement of the two fore legs 14: Hold the two handlebars 26 and draw backward without pressing down the control lever 26 (in reverse motion against above-described step 1). Because the driving wheel gears 25 are also at normal condition, the wheels 252 are driven to rotate forward and will not rotate backward. Therefore, the operating lever 224 of the fore leg driving bracket 22 is directly to drive the fore leg actuating frame 222 and the accompanied fore legs 14 to move forward while the two hind legs remain immovable.

Figure 3:
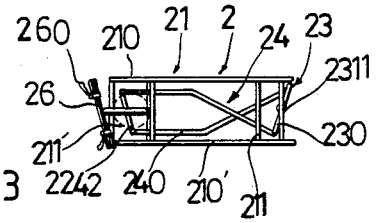
FIG. 3 is a schematic view drawing of the control lever of the front driving bracket of the driving mechanism when it is operated to make leftward turning motion.
Figure 4:
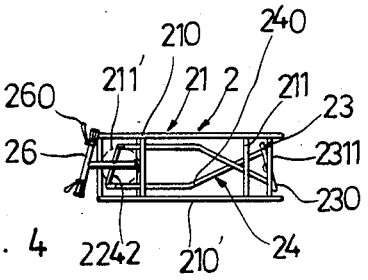
FIG. 4 is a schematic view drawing of the control lever of the front driving bracket of the driving mechanism when it is operated to make rightward turning motion.
Figures 1, 3:
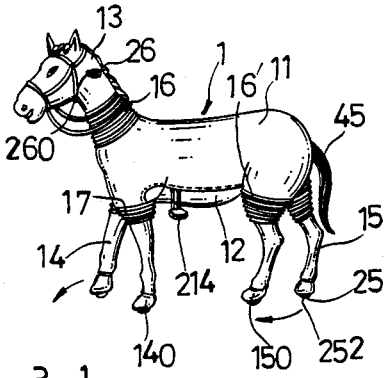
Figures 1, 4:
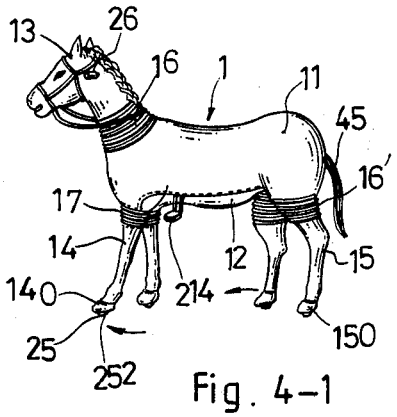

3. Forward movement of one fore leg 14 and one hind leg 15: Hold the two handlebars 26 and turn leftward or rightward (as shown in FIGS. 3 and 4) without pressing down the control levers 260, the right fore leg 14 and left hind leg 15 or the left fore leg 14 and right hind leg 15 will be driven to move forward.

4. To take a turn: Hold the two handlebars 26 to turn to the left or the right and to simultaneously rock forward and backward, and the toy animal will turn to the left or right while moving ahead.

5. Continuously forward movement: Hold the two handlebars 26 and repeat the operation to push and draw back the handlebars 26 forward and backward, the present self-propelled horse or animal body will continuously move ahead at a speed in accordance with the operation.

6. Backward movement: Hold the two handlebars 26 with the respective control levers 260 pressed down and rock the handlebars 26, the present self-propelled horse or animal will move backward.

In general, as described above, the present invention provides such a self-propelled quadrupedal toy which is practical to move forward or backward, or to turn leftward or rightward, or to make jogging, through the operation of the rider, so as to provide much fun while in play.

I claim:

1. A self-propelled toy, comprising:

a hollow body having four legs extending therefrom, each leg having a driving wheel gear at the foot thereof, a driving mechanism arranged within said hollow body for driving said four legs to move said body in forward, backward, leftward, rightward, and jogging movement by alternative movement of two of said four legs;

said driving mechanism including a main frame, fore and rear leg driving brackets for respectively driving fore legs and hind legs of said four legs, and a pair of link levers interconnecting said fore and hind leg driving brackets, said main frame including a pair of D-shaped or flat O-shaped frames spaced apart in parallel and joined together by a plurality of cross bars, two pairs of bearing blocks respectively positioned at a front lower position and a rear upper position of said main frame, two pedals respectively attached to both sides at a front portion of said main frame, and a ring plate for limiting and guiding movement of said fore leg driving bracket, said ring plate being arranged horizontally and attached to said frames and two of said cross bars of said main frame.

2. The self-propelled toy of claim 1, wherein said toy includes an upper body, a bottom abdomen, and a head portion assembled together with said fore legs and hind legs to resemble a quadrupedal animal, said toy further including a neck portion, fore leg joints and hind leg joints comprising one of a pliable soft rubber and corrugated section.

3. The self-propelled toy of claim 1, wherein said fore leg driving bracket includes a locating tube connected to said main frame by a locating bar, an operating lever rotating within said locating tube and a fore leg actuating frame fixedly connected to said operating lever;

said locating tube having a cylindrical portion with a rod protruding outward therefrom;

said locating bar having a central portion with a sleeve vertically arranged at its center for receiving said outwardly protruding rod of said locating tube, and rods of a smaller diameter protruding from both ends of said central portion and inserted into said pair of bearing blocks positioned at a front lower position of said main frame, said fore leg actuating frame having a Y-shaped frame body with upper axial rod and a pair of symmetrical arm rods matching the shape and size of said fore legs of said toy, each said arm rod having said driving wheel gear arranged at its bottom, said upper axial rod rotatably connected to said cylindrical portion of said located tube by a bearing; and said operating lever having an F-shaped frame body with an upper and a lower cross bar, clutch control handles arranged at ends of said upper cross bar for controlling said wheel driving gears, said clutch control handles including control levers and control cords for effecting control of said wheel driving gears, and said lower cross bar being connected to said link levers by pivot joints at each end thereof.

4. The self-propelled toy of claim 1, wherein said hind leg driving bracket includes a hind leg actuating frame pivotally connected to an actuating lever, said hind leg actuating frame being a semi-circular A-shaped tube with a cross piece arranged between extending portions thereof, and having a vertical sleeve arranged at an upper center portion of said A-shaped tube and another vertical sleeve centrally arranged on said cross piece for pivotally receiving said actuating lever, said cross piece additionally having two sleeves respectively arranged near its ends and connected to said link levers by pivot joints, said hind leg actuating frame having an artificial tail assembly including a semi-circular frame with its ends attached to said cross piece, said semi-circular frame having a steering device movably connected to a loop bar by a pivot joint, said loop bar having a slip joint with an extension rod arranged therein, said extension rod having a knuckle at its upper end connected to an U-shaped frame, and an artificial tail pivotally connected to said knuckle, said actuating lever being a T-shaped lever having an upper transverse rod with protruding smaller diameter ends being received by said bearing blocks positioned at a rear upper position of said main frame, and a vertical rod rotatably received by said vertical sleeves of said hind leg actuating frame together with bearings and mounted on top of said hind leg actuating frame and fixed thereto by a cotter pin at a bottom of said vertical rod, and a pair of springs being arranged in a V-shape configuration and connecting said two sleeves of said cross piece to one of said cross bars of said main frame.

5. The self-propelled toy of claim 1, wherein said pair of link levers have one of a straight and an V-shaped configuration, said link levers crossing each other and connecting said lower cross bar of said fore leg driving bracket and said cross piece of said hind leg driving brackets by said pivot joints.

6. The self-propelled toy of claim 1, wherein each said driving wheel gear includes:

a wheel holder having a U-shaped frame plate with an protruding sleeve extending from its top, said protruding sleeve connecting said driving wheel gear to a foot end of each of said four legs, a driving wheel mounted within said wheel holder and having an axle with first a hub and then a rubber tire arranged thereon, an inner wall of said hub having a slot with an internal gear therein, a ratchet holder having an H-shape with two lateral disc plates mounted on said axle inside of said internal gear and within said slot, left and right brake shoes, each brake shoe having a curved plate with several protruding teeth, said left and right brake shoes being mounted between said disc plates of said ratchet holder by a pin, a cam shaft extending from an outer side of said of wheel holder and passing through a hole in said ratchet holder for pivotally holding a cam wheel between said brake shoes for selectively engaging either of said brake shoes, a rocker extending from the cam shaft at an outer end thereof and connected to one of said control cords, a brake spring attached to said ratchet holder by a bolt extending beyond said outer side of said wheel holder, said spring being arranged between said brake shoes and pushing said brake shoes outward, said spring including a coil with two extension at both ends respectively set in a slot of each brake shoe, wherein said control cords connect said cam wheel of said driving wheels to said control levers of said control handles, and operation of said control levers selectively permits forward and backward movement of said legs by causing said cam wheel to selectively engage said internal gear with one of said left and right brake shoes.

* * * * *